United States Patent [19]

Faulin

[11] 4,168,085

[45] Sep. 18, 1979

[54] STRUCTURE FOR FASTENING SKIS TO A SKIER'S FEET

[76] Inventor: Antonio Faulin, Via G. Da Procida, 4, Milan, Italy

[21] Appl. No.: 788,487

[22] Filed: Apr. 18, 1977

[30] Foreign Application Priority Data

Apr. 28, 1976 [IT] Italy ..... 22776 A/76

[51] Int. Cl.[2] ..... A63C 9/086

[52] U.S. Cl. ..... 280/618

[58] Field of Search ..... 280/611, 618, 613, 614, 280/615, 623, 626

[56] References Cited

U.S. PATENT DOCUMENTS

| | | | |
|---|---|---|---|
| 3,998,474 | 12/1976 | Marker | 280/618 |
| 4,026,576 | 5/1977 | Frechin | 280/618 X |

*Primary Examiner*—Joseph F. Peters, Jr.
*Assistant Examiner*—Gene A. Church
*Attorney, Agent, or Firm*—Guido Modiano; Albert Josif

[57] ABSTRACT

A ski binding comprising a plate-like elongate member removably attachable to a ski and detachably engageable with the sole of the skier's shoe, a lug projecting laterally from the plate-like member and a substantially rigid rod pivoted to the lug about an axis perpendicular to the longitudinal extension of the elongate plate-like member and parallel to the surface of the plate-like member. The rod has an "U"-like portion associable with a skier's leg at the tibia region.

16 Claims, 10 Drawing Figures

47a
46
48c
72
73
48a
45
44
43
40
3
22
27
24a
25
26
1
28
28a
4
20
6
5
21
9
10
2
8
7
11
12
13
14

41a
41b
41c
41d
41e
1
3
5
6
7
8
9
10
22
26
27
28
28a
40
41
43
44
45
50
51
52
53
53a
54
55
60
61
62
63
64
70
72
73
80
100
48c

STRUCTURE FOR FASTENING SKIS TO A SKIER'S FEET

BACKGROUND OF THE INVENTION

This invention relates to a ski binding.

The connection of skis to skier's feet is currently implemented as a combination of two elements which are complementary to each other, namely ski bindings and ski boots or shoes, the ski bindings being attached to the skis.

During the skiing action, the boot is held secured to the ski by the binding, the boot being in turn effective to prevent the tibia of the skier from moving forward and backward as well as sideways.

Modern ski bindings are designed such that when the relative stresses between ski and boot exceed a certain value, the boot is released from the binding and comes loose from the ski.

The majority of ski bindings comprise a toe piece and a heel piece secured to the ski, respectively located facing the boot toe and boot heel portions; the boot is made rigid with the ski by these two members of the binding which compress its sole portion axially and against the ski upper surface back.

Some ski bindings further include a plate member acting as an intermediate member between the sole, and toe and heel piece, respectively. With this arrangement, a drawback of prior art bindings is obviated: i.e. the contact areas between the boot heel and sole, which for a given binding have a set that varies with the boot type, and for a given boot design with the binding type. The cited plate member acts as a more accurately fitting and suitable sole for that type of toe and heel piece pair. In any case, however, the connection of the boot to the ski is provided by the strong pressure exerted by the sole, or additional plate, on the ski.

Structurally, the ski boot is essentially a rigid tube wherethrough the calf portion of the skier's leg is inserted. The basic function of the boot/tube is to prevent the tibia from moving sideways with respect to the ski, in order to achieve so-called "edging", which involves stresses that the ankle is anatomically unsuited to withstand, since the human foot is built for resting flat onto the ground. (The more rigid is the boot, the higher is the edging attitude).

Concurrently with the above, the boot also prevents the tibia from swinging freely forwards and backwards. Whereas a backward constraint may in some instances contribute to the skier's balance, who thus gets support against a backward tip, the impossibility of leaning the tibia forwards adversely affects the power of absorbing ground irregularities (such as humps and hollows), and forces the skier to an unnaturally set back position with attendant rearward shifting of his center of gravity to an attitude which is inconsistent with a good skiing attitude.

Furthermore, in the event of a fall, such an inability to lean the tibia, particularly when falling on the face, prevents the skier from reacting in a most natural of manners and taking a falling attitude of least hazard.

It is indeed in the most hazardous of falling conditions, i.e. when the ski is at a hollow in the ground, under high bending load (tip and tail portions raised, middle portion of the ski loaded downwards), that the combined pressure of the toe and heel pieces against the sole, and of the latter against the ski, increases enormously, thus hindering the release of the binding.

Finally, as regards the ski boot itself, it is a heavy kind of footwear, quite unsuitable for normal walking or car driving purposes, being destructive of any sensing capacity of the foot. Since the boot is made rigid externally, the required inner padding in combination with the soft flesh tissues surrounding the tibia, adding to the play created between the sole, heel and ski, does not permit a proper control of side inclination, the foot moving within its seat, while the use of ski boots, besides favoring the insurgence of fractures in the longer bones, also invites edema, lesion, and deformation, as well as poor blood circulation to the lower limbs.

SUMMARY OF THE INVENTION

It is an object of this invention to improve on this overall picture of the situation by providing a novel and improved ski binding which affords:

(a) improved side control for edging;

(b) back support, with a release device that only concerns the tibia area;

(c) the possibility of leaning the tibia fully forwards with a resilient, progressive and adjustable bias;

(d) greater independence of ski flexing and sole-ski friction for the release device;

(e) forward release capabilities (in addition to sideward and upward releasing), and support at areas which are anathomically more suited to withstand the required efforts;

(f) the adoption of footwear of a perfect anathomical design, having a soft vamp and sole, provided with non-slipping soles, thermally insulating and protective of the most vulnerable parts of the foot and leg, while lightweight and suitable for walking as well as car driving;

(g) a ski binding so designed as to protect the tibia from any shock loads;

(h) release of the binding from the ski and, if necessary, of the footwear from the binding;

(i) manual release of the binding from the ski for quick portability, and possibility of re-latching it, also manually;

(j) an overall weight of the binding which is lower than that of prior art bindings;

(k) the removal of stiffening effects at the middle portion of the ski, as due to the secured footwear/binding combination;

(l) adaptability, without alteration, to ski-mountaineering;

(m) a single arrangement of the ski-securing holes for gentleman's size, lady's size and boy's size shoes.

These and other objects, such as will be apparent here-inafter, are achieved by a ski binding comprising a plate-like elongate member removably attachable to a ski, automatic release latching means for securing said plate-like member to the ski, a lug projecting laterally from said plate-like member, a substantially rigid rod-like member associable with a skier's leg at the tibia region and pivotally engaging with said lug, said rod-like member being pivotable about a horizontal axis substantially perpendicular to the ski longitudinal extension, against the bias of resilient means provided in said rod-like member, said plate-like member being detachably engageable with the sole of the skier's shoe.

BRIEF DESCRIPTION OF THE DRAWINGS

Further features and advantages will be better apparent from the following detailed description of a preferred but not restrictive embodiment of the invention, illustrated by way of example and not of limitation in the accompanying drawings, where.

DESCRIPTION OF THE PREFERRED EMBODIMENTS

Figure 8:
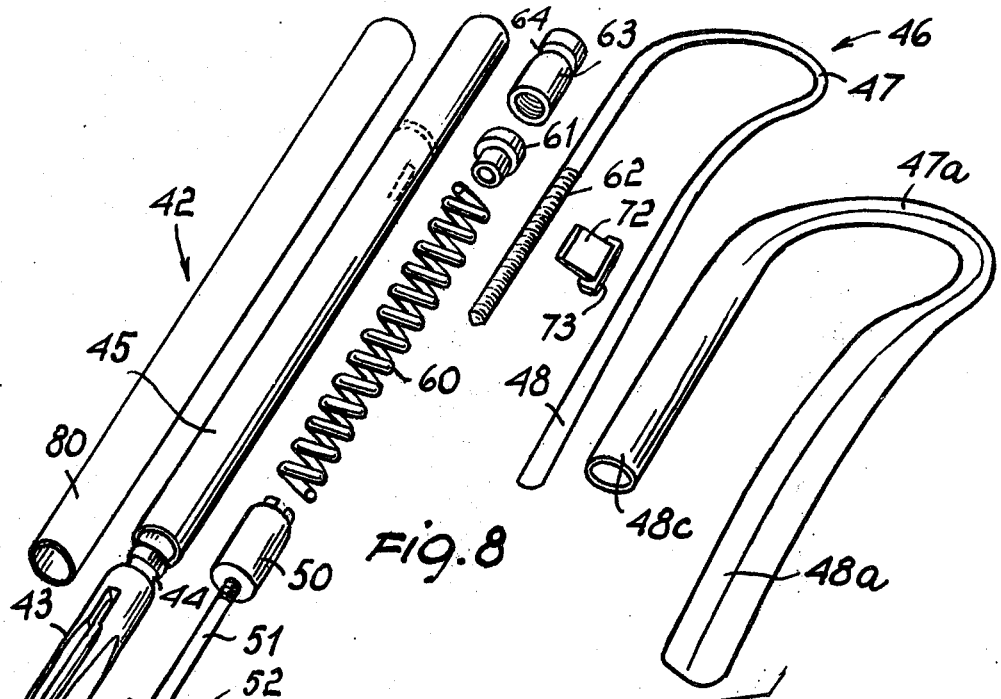
FIG. 8 is an exploded view showing in detail the rod-like member.
Figure 1:
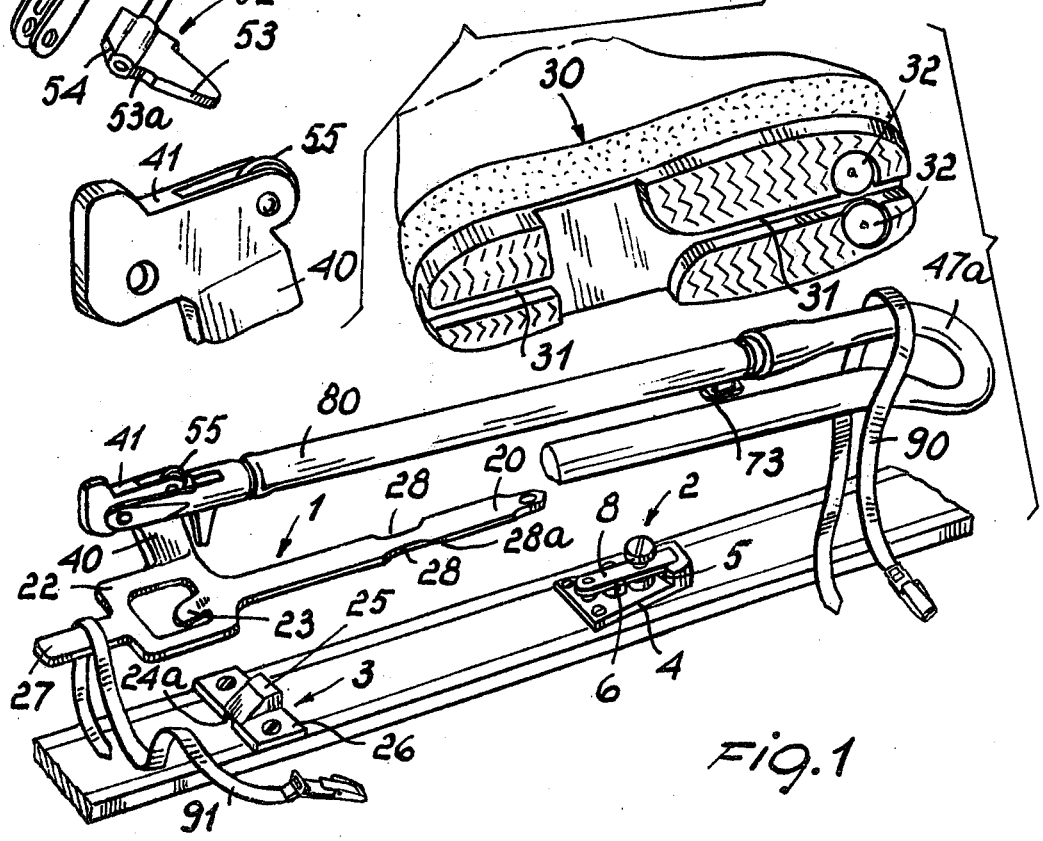
FIG. 1 is a perspective view of a ski fastener according to the invention.
Figures 2, 3, 4, 5, 6, 7:
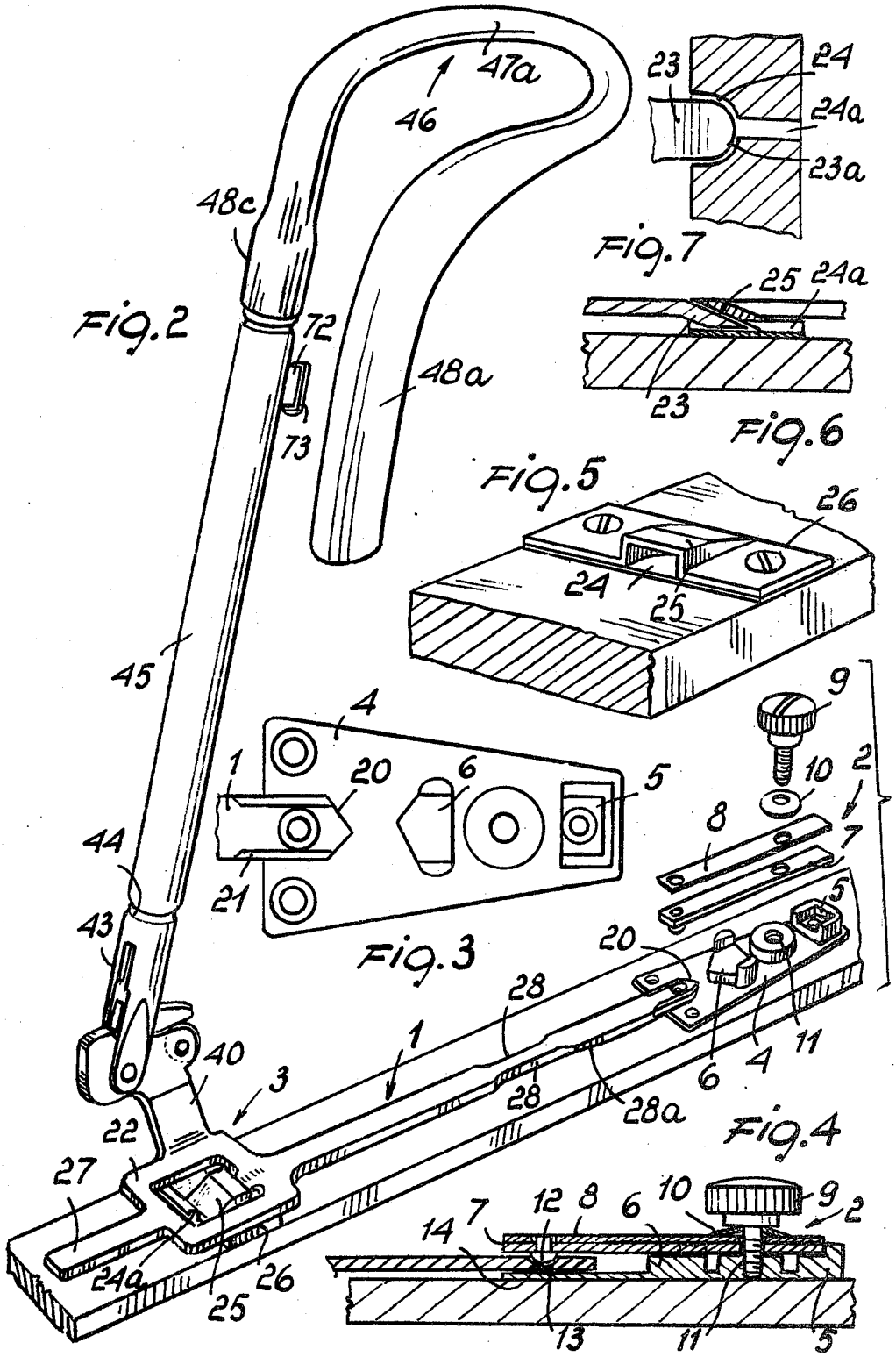
FIG. 2 shows the ski binding substantially as in the operative position, the front latching means of the plate-like member being shown in exploded view.
FIG. 3 shows the front latching means with the upper parts omitted from view.
FIG. 4 is a longitudinal sectional view of the front latching means.
FIG. 5 is a perspective view of the rear latching means.
FIG. 6 is a longitudinal sectional view of the rear latching means.
FIG. 7 is a partly cut away plan view of the rear latching means.

Making reference to the cited figures of the drawings, the ski binding according to this invention comprises a plate-like elongate member, generally indicated at 1, which can be removably attached to a ski through an automatic release latching means including front latching means, generally indicated at 2, and rear latching means, generally indicated at 3.

Said front latching means comprises a block 4 which is secured with usual means to a ski, and has a front boss 5 and a rear boss 6. On such bosses, 5 and 6, a first reed 7 is mounted, which may be overlapped by a second reed 8, having a calibrated flexibility, said reeds being secured to said bosses, 5 and 6, by a large head screw 9 and a cup washer 10, the screw 9 threadably engaging a threaded hole 11 formed between said bosses, 5 and 6. It should be noted that the position occupied by the screw 9, i.e. between the bosses 5 and 6, permits the binding release force to be in no way influenced by the force exerted in tightening the screw 9, which is useful to prevent improper tightening to a wrong torque value and consequent damage; the release force is only determined by the type of reeds 7 and/or 8 used and having a calibrated degree of flexibility. On the bottom face of the first reed 7, at the free end thereof, a lug 12 is provided, which is adapted to engage with a through hole 13, which has a countersink 14 at its top and is provided at the front end of the plate-like member 1. The through hole 13 is such that any snow residues accumulated in the hole may be discharged at the bottom without affecting the front latching system.

The rear boss 6, on the side facing the plate-like member 1, is configurated as an asymmetrical "V", and so is the front end 20 of the plate-like member 1, such that the two tips of the ends of the plate-like member 1 and rear boss 6 are never in alignment, and this in order to avoid the risk of the plate-like member 1 to collide with the rear boss 6 during the automatic release step of the latch.

The front end 20 of the plate-like member 1 has, preferably at the sides, bevels 21 which facilitate the snap insertion of the lug 12 into the frustum flare 14 of the hole 13.

The plate-like member 1 has, close to the rear end, a widened portion 22, at a middle portion whereof a tab 23 is provided extending toward the rear part of the plate-like member 1 and sloping toward the ski whereto the plate-like member has to be attached. When the plate-like member 1 is attached to the ski, said tab 23 is accomodated within a notch 24 having at the top a sloping wall 25, defined in a rear block 26 affixed to the ski; moreover, it should be added that the free end **23*a* of the tab 23 is configurated substantially like a half circle, and the tab 23 has a length dimension such that it cannot reach the bottom of the notch 24 in the normal operating conditions; furthermore, the notch 24 has a discharge hole 24*a*** effective to prevent the accumulation of any snow residues.

From the widened portion 22, there extends a rear tail piece 27 which is arranged in alignment with the plate-like member 1.

The plate-like member 1, near its front end, has a pair of opposite recesses 28 for engagement with the sole 30 of the skier's footwear. More specifically, said sole 30 has a central longitudinal cut-out or groove 31 in the front sole portion and in the heel of the shoe; in the front sole portion there are also provided two circular recesses each accomodating a disc 32 entesing, at least in part, the groove 31; the discs 32 are insertable into said recesses 28 and when the foot is moved forwards they became arranged beneath the plate-like member 1, such as to anchor the sole 30 to the plate-like member 1; preferably, the recesses 28 have a lead-in portion **28*a* which facilitates the insertion of the discs 32 beneath the plate-like member 1**.

The sole 30, after it has been positioned on the plate-like member 1, is arranged such that it is practically astride the plate-like member 1 at the narrow area thereof and the tail piece 27, the widened portion 22 being arranged at the foot hollow and its front portion abutting the front portion of the sole 30 when a rearward movement of the foot should take place, whereas the heel abuts the rear portion of the widened portion 22 when a forward movement of the sole should occur.

It should be noted, moreover, that the discs 32 are provided at the front portion, such as to hold the shoe toe depressed in order to avoid undesirable snow penetration. Obviously, if desired, it is possible to provide several pairs of discs 32, in which case provision will be made for corresponding further pairs of recesses in the plate-like member 1.

Furthermore, it should be added that the coupling of the plate-like member 1 to the ski is particularly stable since, at the widened portion 22, the plate-like member 1 is connected to the ski at different planes; in fact, the widened portion 22 rests on the block 26 at two points located on the sides of the notch 24, and is connected to the ski through the tab 23, between the cited two resting points and positioned at a different level with respect to said two resting points.

From said plate-like member 1, at said widened portion 22, there extends laterally upwards a lug 40 having at the top a cam shaped edge 41, as described hereinafter; with said lug 40, there engages pivotally about an axis substantially perpendicular to the ski longitudinal extension and parallel to the ski upper surface a rod-like member generally indicated at 42, which is substantially rigid and associable with the leg of the skier at the tibia region.

Said rod-like member 42 has at the bottom a yoke member 43 pivotally connected, about said axis, with the lug 40 and connected at the top, through a lower rolled neck 44, to a tubular member 45 to the top whereof an elbow member 46 is associated which has a substantially U-like front portion 47 so arranged as to be at a front leading position with respect to the skier's leg; the portion 47 terminates with a free end portion 48 contact engaging the tibia side portion, thereby the tibia rests on one side against the tubular member 45 and on the other side against the end portion 48, the length of the tubular member 45 being such that the elbow member 46 is disposed of preference slightly below the knee of the skier's leg. In this manner, even though the leg length may vary within limits, it is at all times ensured that the rod-like member 42 adequately contacts the outside of the calf and tibia region, whereas the front portion 47 does not rest against the leg.

Internally to the tubular member 45, there are provided elastic or resilient means, possibly preloaded ones, which oppose the swinging movement of the tubular member 45 about the pivoting axis. More precisely, within the tubular member 45, at the bottom portion thereof, a cylinder 50 is slidable, the lower end whereof abuts the lower rolled neck 44. A stem 51 extends down from the cylinder 50 out of the tubular member 45. At one end the stem 51 is provided with a rest 52 having at its lower portion an elongated bevel 53 as well as a rear bevel 54: moreover, the rest 52 has a recessed portion **53*a* at the middle area thereof. The bottom portion of the rest 52 acts by contact against said cam shaped edge 41 of the lug 40. Said stem 51 is connected with said cylinder 50 through a threaded portion such that, whenever desired, the rest 52 may be replaced. Furthermore, at the front rounded edge portion of edge 41 there is pivotally arranged a roller 55 having the function of reducing the frictional resistance between the rest 52 and edge 41 during the oscillation of the rod-like member 42 with respect to the lug 40**.

Within the tubular member 45 there is provided a cylindrical coil spring 60 acting between the cylinder 50 and a perforated plate 61 whereon the threaded end 62 of said elbow member 46, opposite the free end portion 48, acts. Said threaded end 62 is screwed into a threaded bushing 63 provided at the top of said tubular member 45 and axially locked therein through an upper rolled neck 64.

It will be apparent that by threading to a larger or lesser extent the threaded end 62 into the bushing 63, the spring 60 compressive force is varied, and accordingly the preload of the spring 60 itself.

Figures 9, 10:
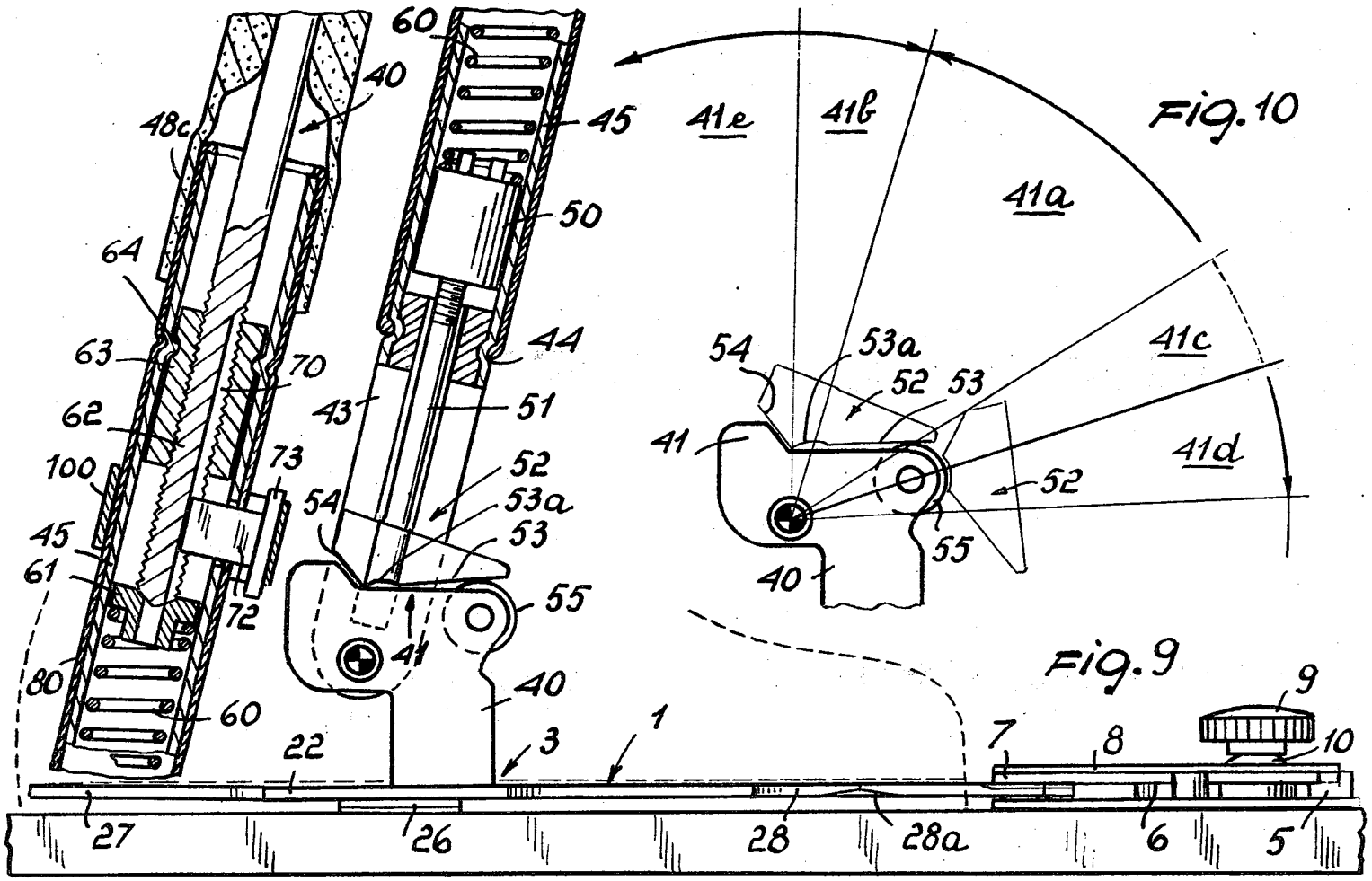
FIG. 9 shows the rod-like member in longitudinal section.
FIG. 10 shows schematically the various operative positions which the rod-like member may take with respect to the lug wherewith it is pivotally connected.

Said threaded end 62 has at the front side a longitudinal slot 70, wherewith a pawl 72 provided with a large head 73 engages through the tubular member 45, in order to prevent the elbow member 46 from rotating, thereby retaining the elbow member always at one and the same angular position, i.e. with its front portion 47 symmetrical with respect to a plane perpendicular to the pivoting axis of the rod-like member 42 and passing therethrough. By inspection of the cam edge 41 of the lug 40, it may be seen that the cam edge, in cooperation with the rest 52 shaped as mentioned above, defines a number of positions of the rod-like member 42, which are best indicated in FIG. 10. In FIG. 10, the segment **41*a*, delimited by two radii corresponding to the axes of the rod-like member 42 in two differently inclined positions whereat the front bevel 53 of the rest 52 contacts substantially a horizontal straight edge portion of the cam edge 41, represents a number of operating positions in which the resilient means constituted by the spring 60 urging the rest 52 against the horizontal portion of the cam edge 41 tends to bring the rod-like member 42 back to a stable, slightly forward leaning, position, as indicated schematically by the arrow in FIG. 10 and represented in FIG. 9. The segment 41*b*, corresponding to the portion whereat the rear bevel 54 of the rest 52 engages with the inclined raising portion formed on the cam edge 41, represents a number of positions in which the resilient means 60 tends, in the event of a rearward tipping tendency, to again bring the rod-like member 42** back to the said stable position.

The segment **41*c*, whereat the recessed portion 53*a* of the rest 52 engages with the roller 55 at an area located above an imaginary line connecting the hinge point of the rod-like member 42 to the center of the roller 55, represents an area of neutral balance wherein the resilient means 60 produces no further displacement of the rod-like member 42. The segment 41*d* represents in practice the idle or rest area, where the recessed portion 53*a* of the rest 52 engages with the roller 55 beyond said imaginary line and causes the rod-like member 42 to reach, in practice, a rest position corresponding to the position whereat the axis of the rod-like member 42** is arranged substantially horizontally and parallel to the ski extension.

The segment **41*e*, corresponding to the portion of the edge 41 where the rear bevel 54 of the rest 52 has moved past the inclined raising portion of the cam edge 41 and faces a further straight portion thereof, represents an area where the rod-like member 42** is free to rotate backwards, i.e. towards the rear portion of the ski.

Preferably around the tubular member 45, a sleeve 80 of a plastic material is provided, though not necessarily a padded one, serving merely as a coating for the tubular member 45 to protect it from corrosion and to provide better friction contact with the skier's leg. At this area, a padding would be of no use since the tubular member rests itself against the outer muscle of the leg.

The elbow member 46 is instead padded, and has a rather substantial padding **48*a*, at the end portion 48, since the end portion 48 rests on the tibia bone, thereby some padding becomes necessary to avoid discomfort for the skier; on the front portion 47 there is provided a pad 47*a*** of smaller thickness, acting only as a protection after the ski has come loose, in cases such as when the binding is accidentally released to attenuate the shocks against the skier.

On the opposite side with respect to the pad **48*a*, a sleeve member 48*c* is provided, made of rubber or a plastic material, and intended to overlap, at least for some length, the tubular member 45, said sleeve member being also effective to cover the upper part of the tubular member 45 irrespective of the length of threaded end 62 threaded into the threaded bushing 63**.

The ski binding also comprises an upper strap 90, which is arranged at the upper end of the tubular member 45, and is so designed as to surround the calf for a virtually stable association to the elbow member 46; moreover, a lower strap 91 is provided which engages, of preference, under the widened portion 22 of the plate-like member 1 and encircles the foot neck in order to keep the heel of the shoe connected to the plate-like member 1, and consequently the skier's foot against the ski, said straps 90 and 91 being possibly of an elastic material having a calibrated elasticity and adjustable at will according to the skier's own requirements.

The application and operation of the ski binding according to the invention are as follows. To apply the plate-like member 1 and the rod-like member 42 of the binding to the ski, i.e. to connect them to the front and rear latching means 2, 3, the tab 23 is first inserted into the notch 24 of the rear latching means 3, then the countersink 14 of the through hole 13 in the plate-like member 1 is placed beneath the lug 12 provided on the first reed 7 of the front latching means 2, which operation is facilitated by the bevel 21.

Following the above steps, the binding is now connected to the ski, and the rod-like member 42 is next arranged in its operating position, which position lies substantially within the segment 41*a* shown in FIG. 10; in this condition, the rod-like member 42 is leaning forward with an inclination substantially corresponding to the inclination of the tibia on the ski, as adopted in practicing skiing. Then depending on individual requirements, the resilient or elastic means is preset, i.e. by rotation of the elbow member 46 with respect to the threaded bushing 63 the spring 60 is preloaded such as to produce the desired biassing force. To rotate the member 46, the pin 72 is disengaged from the longitudinal slot 70 formed in the threaded end 62. Said pin may be retained either by a resilient strap 100 associated externally to the tubular member 45 or by placing it under the sleeve 80 covering the tubular member.

After the above presetting has been completed, which in actual practice the user will have to do once, so long as it remains constant, the user may fit the ski by connecting, as described hereinabove, the sole 30 of the shoe with the plate-like member 1. Then the user will tighten, if appropriate, the upper strap 90 and lower strap 91.

While skiing, it happens that the elastic or resilient means, preloaded and provided in the rod-like member 42, opposes with a preset force any forward oscillation of the tibia within the area corresponding to the segment 41*c* in FIG. 10, whereas at the subsequent area corresponding to the segment 41*c* in FIG. 10, a free forward swinging movement is permitted.

In the case of a twisting movement of the leg with respect to the foot, which would be extremely hazardous for one's articulations, the front latching means release in that the lug 12 comes out of the countersink 14 of the through hole 13, thus releasing the plate-like member 1 from the latching means.

In the event of a fall on the face, the same releasing action occurs, while avoiding, as mentioned above, in the most absolute of manners any accidental interference of the front end of the plate-like member 1 with the rear boss 6, since their tips will never be in alignment, thereby the plate-like member 1 slides out forwards to release the skier's foot from the ski.

In the case of a backward tipping tendency of the skier with respect to the skis, the rod-like member 42 is so arranged as to oppose it up to a certain value (segment 41*b* in FIG. 10), thereby the skier is allowed to recover his balance, and if a given value is exceeded (segment 41*e* in FIG. 10) then the rest 52 jumps over and past the step-like portion of the cam edge 41 swinging backwards.

In the event of considerable pull of the rear strap on the plate-like member 1, it happens that owing to the sloping configuration of the upper wall 25 of the notch 24 and to the corresponding inclination of the tab 23, it becomes possible in the event of an abnormal stress to cause the tab 23 to free itself from the notch 24, thereby the plate-like member 1 is released from the ski.

It should be added that, in the case of the ski flexing or oscillating owing to hollows or the like, no special problems are encountered since, as already described hereinabove, there exists a minimal play or clearance between the end of the tab 23 and the bottom of the notch 24, such that any flexing of the ski is easily absorbed by the binding without it coming loose undesirably, but without hindering the release thereof when appropriate. In the event of a head-on collision, i.e. when a forward-acting horizontal force arises, the plate-like member 1, by overcoming the resistance opposed by the lug 12 engaged in the countersink 14 of the hole 13, moves forwards to free itself from the ski.

When the ski binding according to the invention is no longer in use, it is possible to materially reduce its bulk by folding the rod-like member 42 in a forward direction; to this aim, it is enough to overcome the bias of the spring 60, until the rest 52 is brought practically perpendicularly to the the ski to the position indicated at 41*d* in FIG. 10. In this condition, the rod-like member 42 is held firmly in a position parallel to the ski.

From the above description, it will appear how the invention achieves the objects specified, and in particular the fact is emphasized that, owing to the length of the rod-like member 42, which length may be set and varied at will, the user has a longer lever available, thereby he is allowed to retain a better control of the skis, while doing this with a much lesser effort, this advantage being specially useful for the so-called edging.

Another remarkable advantage resides in that the ski binding according to the invention supports the user in case of a rearward tipping tendency giving him a chance to recover his balance, while in no way hindering a rearward rotation of the rod-like member 42 when the stress becomes too high and actually dangerous.

A further advantage to be pointed out is that the tibia is allowed, to a virtually unlimited extent, to lean forward, thus ensuring a higher degree of freedom for the skier as regards useful movements in practicing skiing.

It should be added, finally, that the latching means provided affords an absolute and complete protection for the leg-foot joints without compelling the skier to use conventional ski boots, which as mentioned hereinabove are considerably heavy and bulky, and restrictive of the skier's foot and leg movements when he simply decides to walk.

The invention as such is susceptible to many modifications and variations, all of which fall within the inventive concept.

Thus, for example, the front latching means 2 may be a block, attachable to the ski, wherefrom a pivot member extends which has at its base a broad shoe piece. With the pivot member, a movable plate may engage which is parallel to and overlaps said block; the engagement between the movable plate and pivot member may be effected through a widened hole of a diameter greater than the diameter of the pivot member, thereby causing the movable plate to float with respect to the pivot member. At the pivot member, there would be provided presettable elastic means active between the movable plate and a nut threadably engaged with the pivot member. Furthermore, said block would have a fixed lug corresponding to a movable lug provided on the movable plate, said lugs engaging in recessed seats formed at the front end of the plate-like member.

The rear latching means could be configurated as a pivot pin, extending from the rear end of the plate-like member and having a broad head for insertion beneath a pair of lips located at a middle portion of an elongate groove affixed to the ski, which would define areas of disengagement of said broad head both before and behind said lips.

Furthermore, all the constructional details may be varied within a broad range, without departing from the present inventive concept.

In practicing the invention, the materials and the dimensions used may vary within a broad range.

I claim:

1. A ski binding comprising a plate-like elongate member having a longitudinal extension, automatic-release latching means for removably connecting said plate-like member to a ski, a lug projecting laterally from said plate-like member, a substantially rigid rod-like member associable with a skier's leg at the tibia region and pivotally connected with said lug about an axis substantially perpendicular to said longitudinal extension of said plate-like elongate member and parallel to the surface thereof, and resilient means provided in said rod-like member for causing said rod-like member to assume selected angular positions with respect to said plate-like member, said plate-like member being detachably engageable with the sole of the skier's shoe.

2. A ski binding according to claim 1, wherein said automatic release latching means comprise a front latching means and a rear latching means, said front latching means including a block attachable to the ski and having a front boss and a rear boss, a first reed fastened near one end to said bosses by means of a screw having an enlarged head and threaded into a threaded hole formed between said bosses, and a lug provided on the lower face of said first reed, at the free end thereof, and adapted to engage in a through hole provided at the front end of said plate-like member.

3. A ski binding according to claim 2, comprising above said first reed, a second interchangeable reed having calibrated flexibility.

4. A ski binding according to claim 2, wherein said rear boss, on the side facing said plate-like member, has an asymmetrical-"V" configuration, the end of said plate-like member facing said rear boss being also asymmetrically configurated.

5. A ski binding according to claim 2, wherein said plate-like member has, at the end thereof facing said rear boss, bevels adapted to facilitate the snap insertion of said lug into said through hole.

6. A ski binding according to claim 2, wherein said plate-like member has a widened portion at a middle portion thereof and said rear latching means includes a tab provided in said widened portion, said tab extending towards the rear of said plate-like member, said rear latching means further comprising a rear block and a notch within said block for removably receiving said tab.

7. A ski binding according to claim 6, wherein the free end of said tab is configurated substantially like a half circle, said tab having a length dimension which is smaller than the depth dimension of said notch.

8. A ski binding according to claim 1, wherein said plate-like member has, near the front end thereof, a pair of opposite recesses for receiving a pair of discs provided in the sole of the skier's footwear, said sole having a longitudinal groove therein between said discs, said discs being insertable into said recesses and shiftable beneath said plate-like member along said longitudinal extension thereof to lock said sole on said plate-like member when said plate-like member is inserted into said longitudinal groove of said sole.

9. A ski binding according to claim 8, wherein said recesses have at the front a lead-in portion effective to facilitate the insertion of said discs.

10. A ski binding according to claim 1, wherein said rod-like member has at one end a yoke member pivotally engaging said lug and at the other end a substantially "U"-like portion arranged such as to be at a front leading position with respect to the skier's leg, said "U"-like portion terminating with an end portion engaging the side part of the tibia of the skier's leg, the other side thereof being engaged by said rod-like member.

11. A ski binding acoording to claim 10, wherein said rod-like member comprises a tubular member, resilient means within said tubular member, a cylinder slidably retained in said tubular member, a stem projecting from said cylinder out of said tubular member, a rest on said stem acting by contact on a cam shaped edge provided on said lug, said resilient means comprising a cylindrical coil spring arranged between said cylinder and said "U"-like portion of said rod-like member.

12. A ski binding according to claim 11, wherein said rest has at the bottom a front bevel and a rear bevel and a recessed portion between said bevels, and said cam shaped edge of said lug has a straight edge portion and an adjacent inclined raising portion followed by a further straight portion at one end of said straight edge portion and a rounded edge portion at the opposite end of said straight edge portion, said cam shaped edge of said lug and said rest defining a plurality of cooperating positions, namely a first number of positions whereat said front bevel of said rest contacts said straight edge portion of said cam edge and said resilient means tends to bring said rod-like member back to an operative position thereof in which said rod-like member is in a slightly forward leaning position, a second number of positions whereat said rear bevel of said rest contacts said inclined raising portion of said cam edge and said resilient means tends to bring said rod-like member back to said operative position, a third number of positions wherein said recessed portion of said rest faces an upper part of said rounded edge portion of said cam edge and said rod-like member is in a position of neutral balance, a fourth number of positions in which said recessed portion of said rest faces a lower part of said rounded edge portion of said cam edge and said rod-like member becomes arranged substantially parallel to said straight edge portion of said cam edge, and a fifth number of positions wherein said rear bevel is arranged facing said further straight portion of said cam edge and said rod-like member is free to rotate backwards.

13. A ski binding according to claim 11, wherein said lug rotatably supports at the front portion of said cam edge a roller adapted to reduce the frictional resistance between said rest and said cam edge during the pivotal movement of said rod-like member with respect to said lug.

14. A ski binding according to claim 11, wherein said "U"-like portion of said rod-like member has a threaded end opposite to said end portion and said rod-like member comprises a threaded bushing for receiving said threaded end, said threaded end having at the lateral side a longitudinal slot wherewith there engages removably a pin passing through said tubular member and adapted to angularly position said "U"-like portion.

15. A ski binding according to claim 10, wherein said "U"-like portion has a padding thereon.

16. A ski binding according to claim 1, further comprising an upper strap associable with the upper end of said rod-like member at the calf of the skier's leg, and a lower strap associable with the rear end of said plate-like member and the neck of the foot of the skier, said upper and lower straps being of an elastic material of calibrated elasticity and provided with quick-release buckles.

* * * * *